US007111590B1

(12) United States Patent
Huang et al.

(10) Patent No.: US 7,111,590 B1
(45) Date of Patent: Sep. 26, 2006

(54) WATER HEATER HAVING WINDPROOF EFFECT

(76) Inventors: Hsin-Ming Huang, 120, Da Hsing St., Taichung (TW); Kuan-Chou Lin, 11F-1, No. 23, Lane 98, Kung Yeh Chu First Rd., Fu En Li, Taichung (TW)

( * ) Notice: Subject to any disclaimer, the term of this patent is extended or adjusted under 35 U.S.C. 154(b) by 33 days.

(21) Appl. No.: 11/130,994

(22) Filed: May 17, 2005

(51) Int. Cl.
*F22B 23/06* (2006.01)

(52) U.S. Cl. ..... 122/209.2; 122/DIG. 2; 122/DIG. 7

(58) Field of Classification Search ..... 122/5.51, 122/4 R, 209.2, DIG. 7, DIG. 2
See application file for complete search history.

(56) References Cited

U.S. PATENT DOCUMENTS 4,129,179 A * 12/1978 Molitor ..... 165/101
4,224,131 A * 9/1980 Acero et al. ..... 204/274
5,346,126 A * 9/1994 Lai ..... 236/1 G

* cited by examiner

*Primary Examiner*—Gregory Wilson
(74) *Attorney, Agent, or Firm*—Alan D. Kamrath; Nikolai & Mersereau, P.A.

(57) ABSTRACT

A water heater includes a housing, an air box, and two windproof hoods. Thus, the waste gas produced by the burner is drained outward smoothly and regularly even when the air current of the ambient environment is disposed at an abnormal and unstable state, so that the water heater has an enhanced air circulation, thereby facilitating operation of the water heater. In addition, the drain pipe is protected by each of the two windproof hoods to achieve a windproof and rainproof effect.

13 Claims, 5 Drawing Sheets

WATER HEATER HAVING WINDPROOF EFFECT

BACKGROUND OF THE INVENTION

1. Field of the Invention

The present invention relates to a water heater, and more particularly to a water heater having a windproof effect.

2. Description of the Related Art

A conventional water heater comprises a housing, a gas burner mounted in the housing for heating the water to produce hot water for use with a user so that the user can take a bath by the hot water, and a drain pipe mounted on the housing for draining the waste gas produced by the burner outward from the housing. However, when the water heater is mounted outdoors and the air condition of the ambient environment is disposed at an unstable state, the air current of the ambient environment easily produces a downward pressure on the drain pipe so that the waste gas produced by the burner cannot be drained outward from the drain pipe and is forced to move back into the housing, thereby affecting operation of the water heater.

A conventional water heater having a ventilating device was disclosed in the Taiwanese Patent Publication No. 422324 and 581230.

SUMMARY OF THE INVENTION

In accordance with the present invention, there is provided a water heater, comprising water heater, comprising a housing, an air box mounted in the housing and having a transversely arranged drain pipe having two distal ends each formed with an outlet hole connected to an outside of the housing, and two windproof hoods each mounted on the housing and each having an inside formed with a guide channel connected to the respective outlet hole of the drain pipe.

The primary objective of the present invention is to provide a water heater having a windproof effect.

Another objective of the present invention is to provide a water heater, wherein the waste gas produced by the burner is drained outward smoothly and regularly even when the air current of the ambient environment is disposed at an abnormal and unstable state, so that the water heater has an enhanced air circulation, thereby facilitating operation of the water heater.

A further objective of the present invention is to provide a water heater, wherein the air circulation of the water heater is maintained at a stable state, so that the temperature of the hot water is kept at a constant value, thereby facilitating the user operating the water heater.

A further objective of the present invention is to provide a water heater, wherein the drain pipe is protected by each of the two windproof hoods to achieve a windproof and rainproof effect.

Further benefits and advantages of the present invention will become apparent after a careful reading of the detailed description with appropriate reference to the accompanying drawings.

DETAILED DESCRIPTION OF THE INVENTION

Figure 1:
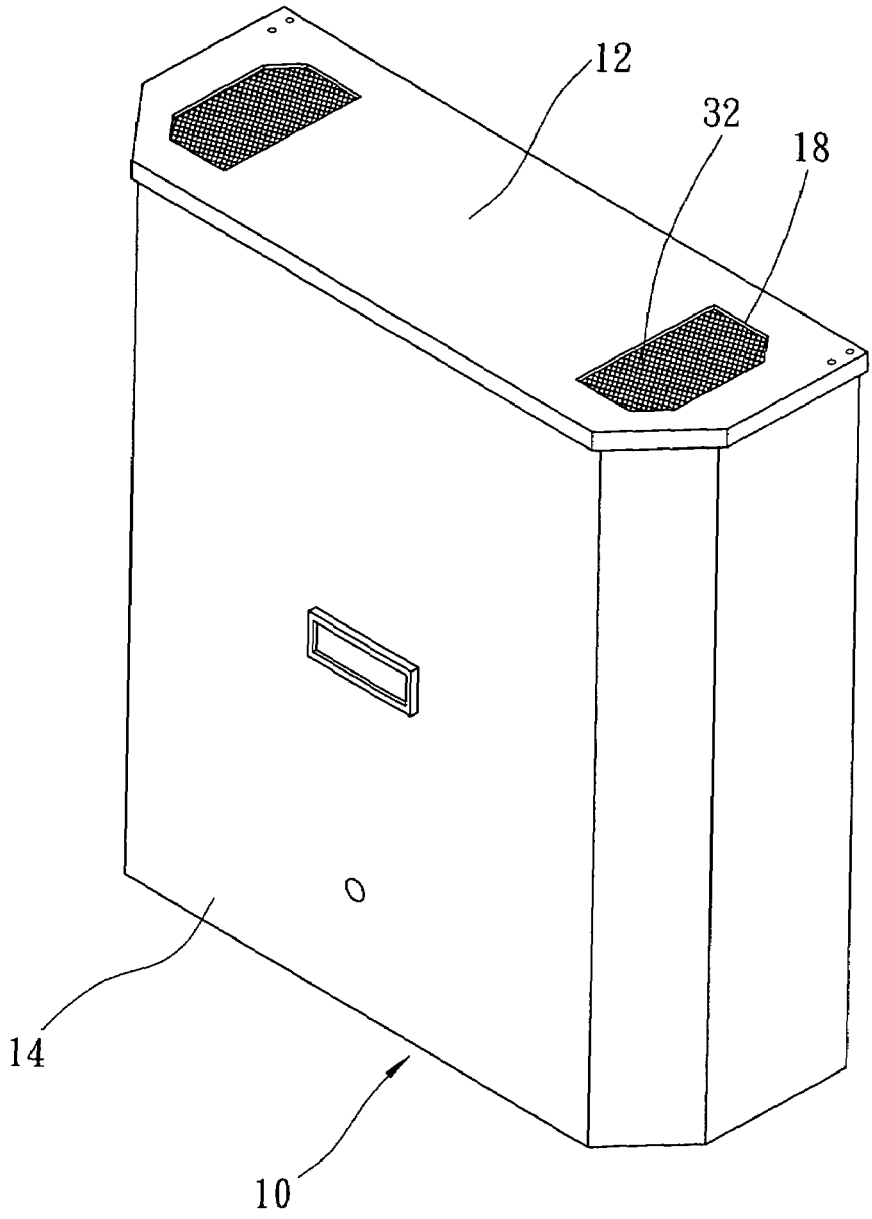
FIG. 1 is a perspective view of a water heater in accordance with the preferred embodiment of the present invention.
Figure 2:
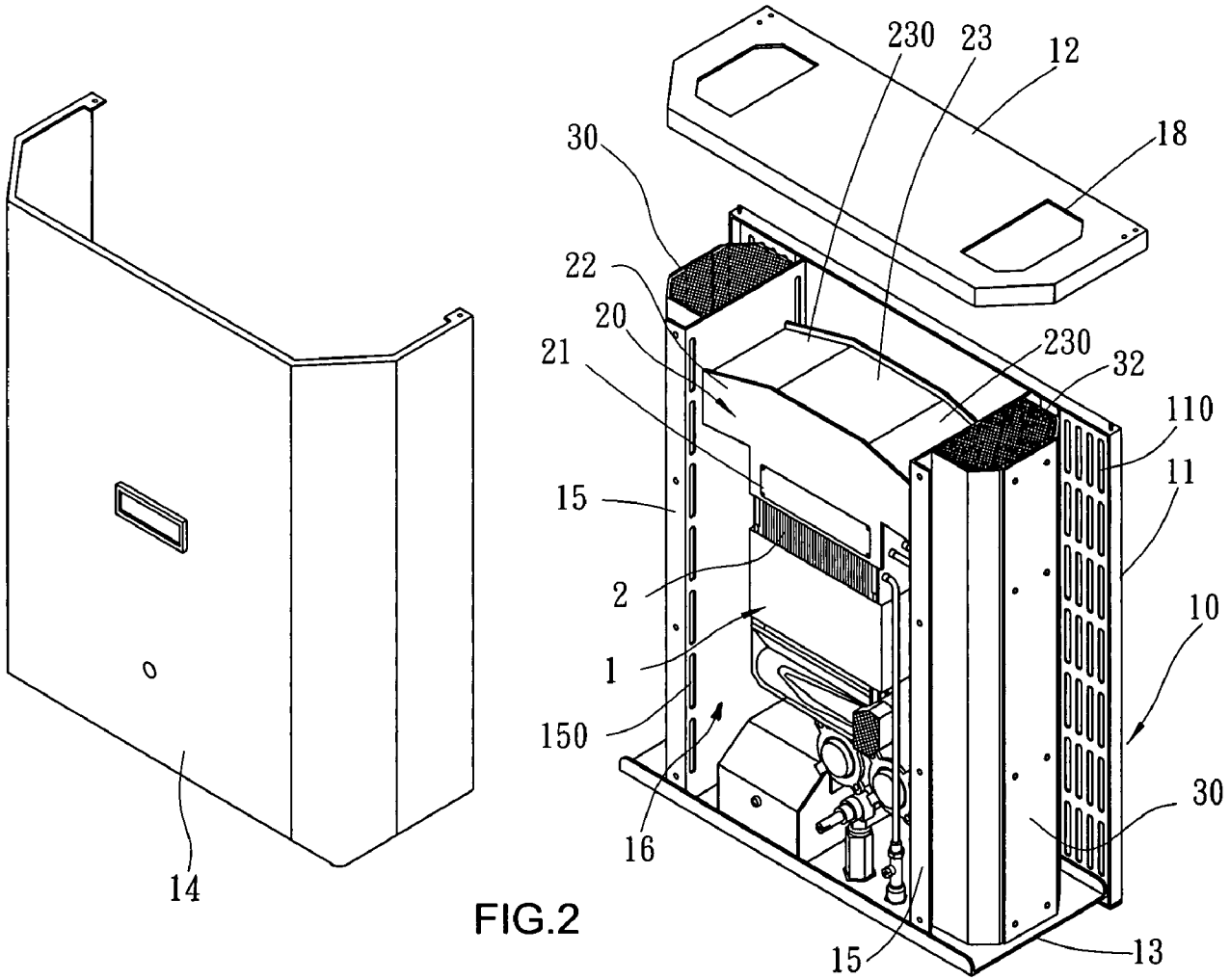
FIG. 2 is an exploded perspective view of the water heater as shown in FIG. 1.
Figure 3:
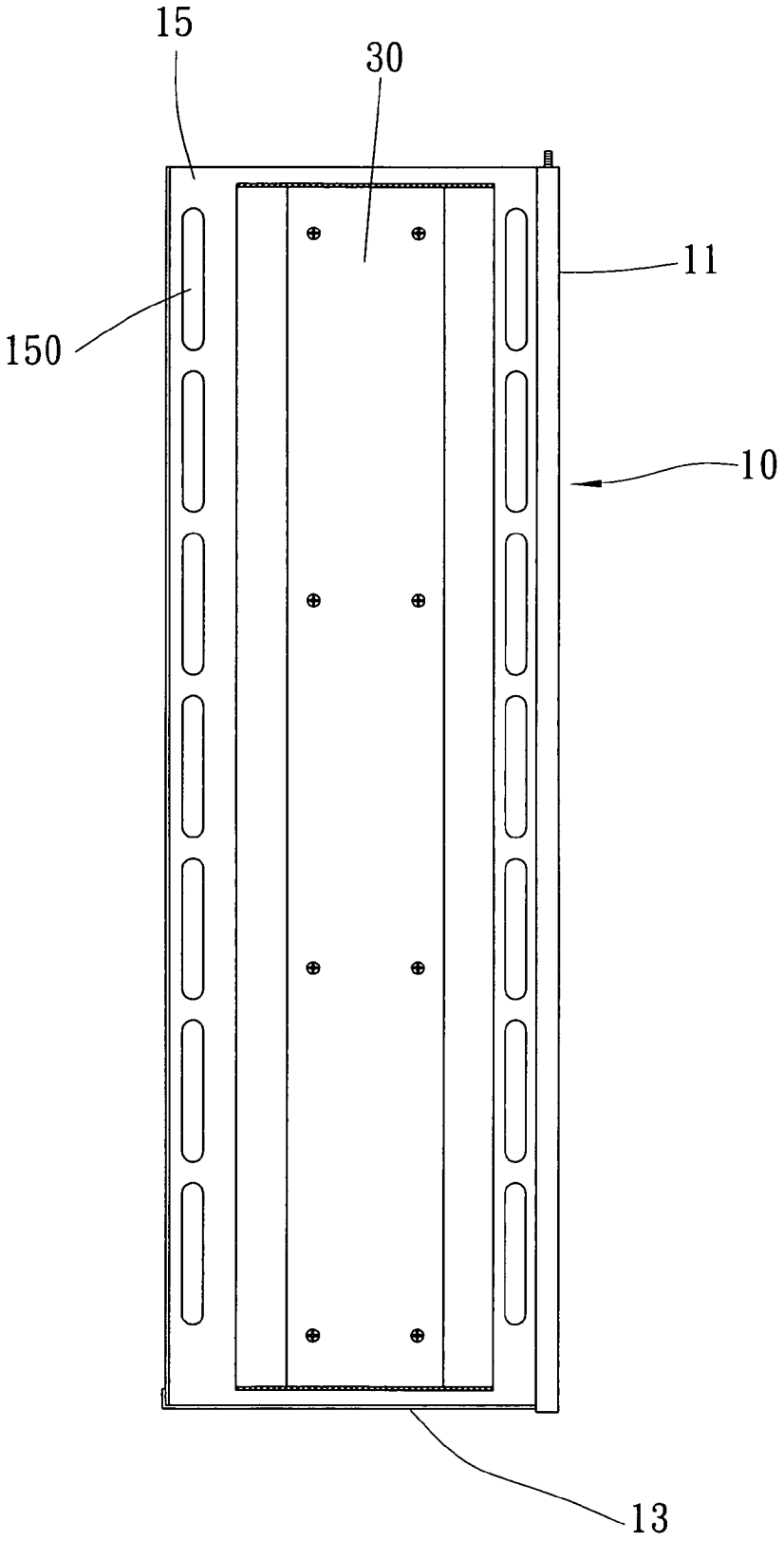
FIG. 3 is a cut-away side plan view of the water heater as shown in FIG. 1.

Referring to the drawings and initially to FIGS. 1–3, a water heater in accordance with the preferred embodiment of the present invention comprises a housing 10, an air box 20, and two windproof hoods 30.

Referring to FIGS. 1–5, the housing 10 includes a back plate 11, a top cover 12 mounted on an upper portion of the back plate 11, a bottom cover 13 mounted on a lower portion of the back plate 11, a faceplate 14 mounted between the back plate 11, the top cover 12 and the bottom cover 13, and two upright base plates 15 mounted between the back plate 11 and the faceplate 14, thereby defining a mounting space 16 between the two base plates 15 for mounting a burner 1, a heat exchanger 2 above the burner 1, an igniter, an electronic control board and a plurality of water pipes.

Figure 4:
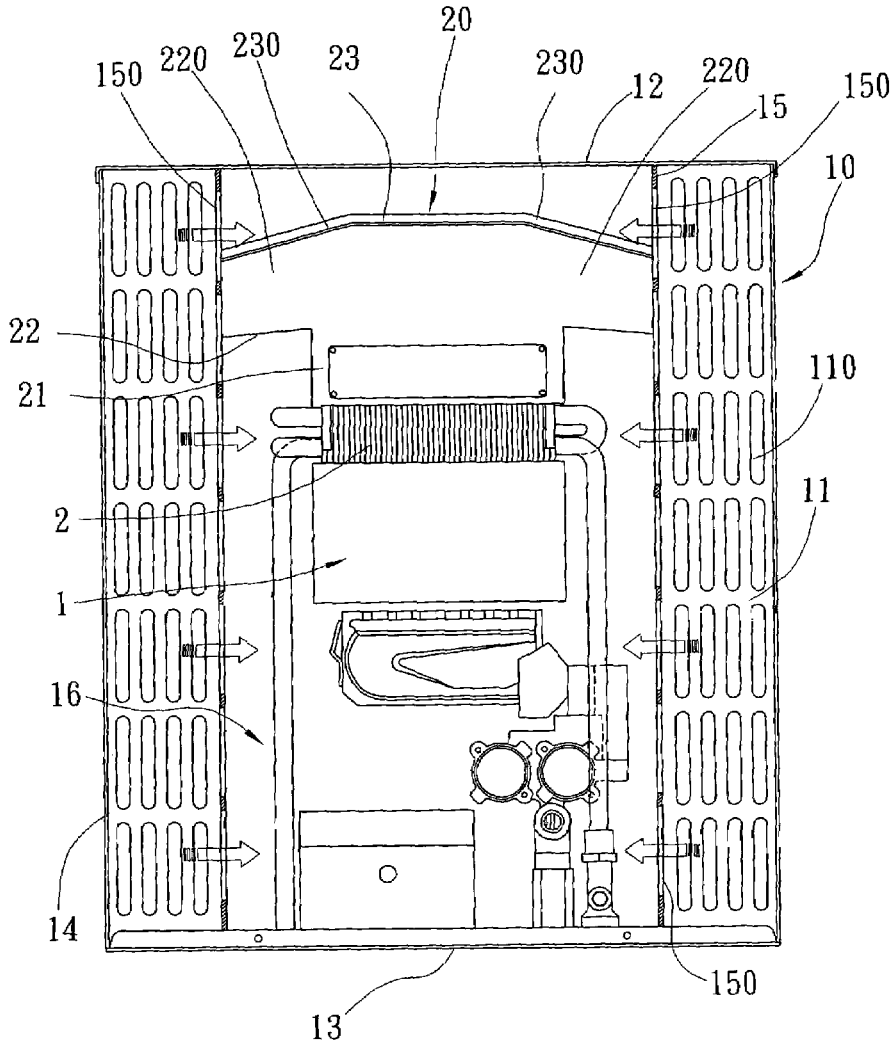
FIG. 4 is a plan cross-sectional operational view of the water heater as shown in FIG. 1.

As shown in FIG. 4, each of the two base plates 15 has two sides each formed with a plurality of air inlet holes 150 connected to the mounting space 16, and the back plate 11 has two sides each formed with a plurality of air inlet bores 110 connected to the air inlet holes 150 of each of the two base plates 15 so that the mounting space 16 is connected to the ambient environment through the air inlet holes 150 of each of the two base plates 15 and the air inlet bores 110 of the back plate 11 to supply a sufficient air to the igniter. Each of the top cover 12 and the bottom cover 13 has two ends each formed with a vent hole 18.

The air box 20 is mounted in the mounting space 16 of the housing 10 and located above the heat exchanger 2 to collect the waste gas produced by the burner 1. The air box 20 is substantially T-shaped and has a lower portion formed with a longitudinally arranged inlet manifold 21 located above the heat exchanger 2 to deliver the waste gas produced by the burner 1 and an upper portion formed with a transversely arranged drain pipe 22 connected to the inlet manifold 21 and having two distal ends each extended through the respective base plate 15 and each formed with an outlet hole 220. The drain pipe 22 of the air box 20 has a top plate 23 having a flat mediate portion and two oblique end portions 230 each extended downward toward the respective outlet hole 220 of the drain pipe 22 to introduce the waste gas from the inlet manifold 21 into the respective outlet hole 220 of the drain pipe 22.

Each of the two windproof hoods 30 is mounted on the respective base plate 15 and connected to the drain pipe 22 of the air box 20. Each of the two windproof hoods 30 has an inside formed with a guide channel 31 connected to the respective outlet hole 220 of the drain pipe 22 and connected to the respective vent hole 18 of each of the top cover 12 and the bottom cover 13 so that the drain pipe 22 is connected to the ambient environment through the guide channel 31 of each of the two windproof hoods 30 to drain the waste gas produced by the burner 1 outward from the housing 10. An inclined angle is defined between the guide channel 31 of each of the two windproof hoods 30 and the respective outlet hole 220 of the drain pipe 22 so that the drain pipe 22 is protected by each of the two windproof hoods 30 to achieve a windproof and rainproof effect. Preferably, the guide channel 31 of each of the two windproof hoods 30 is perpendicular to the respective outlet hole 220 of the drain pipe 22. Each of the two windproof hoods 30 has two ends each provide with a net 32 to prevent a foreign object from entering the windproof hoods 30.

When the air current of the ambient environment is disposed at a normal state, the waste gas produced by the burner 1 is introduced by the outlet holes 220 of the drain pipe 22 into the guide channel 31 of each of the two windproof hoods 30, then delivered upward in the guide channel 31 and is finally drained outward from the respective vent hole 18 of the top cover 12.

Figure 5:
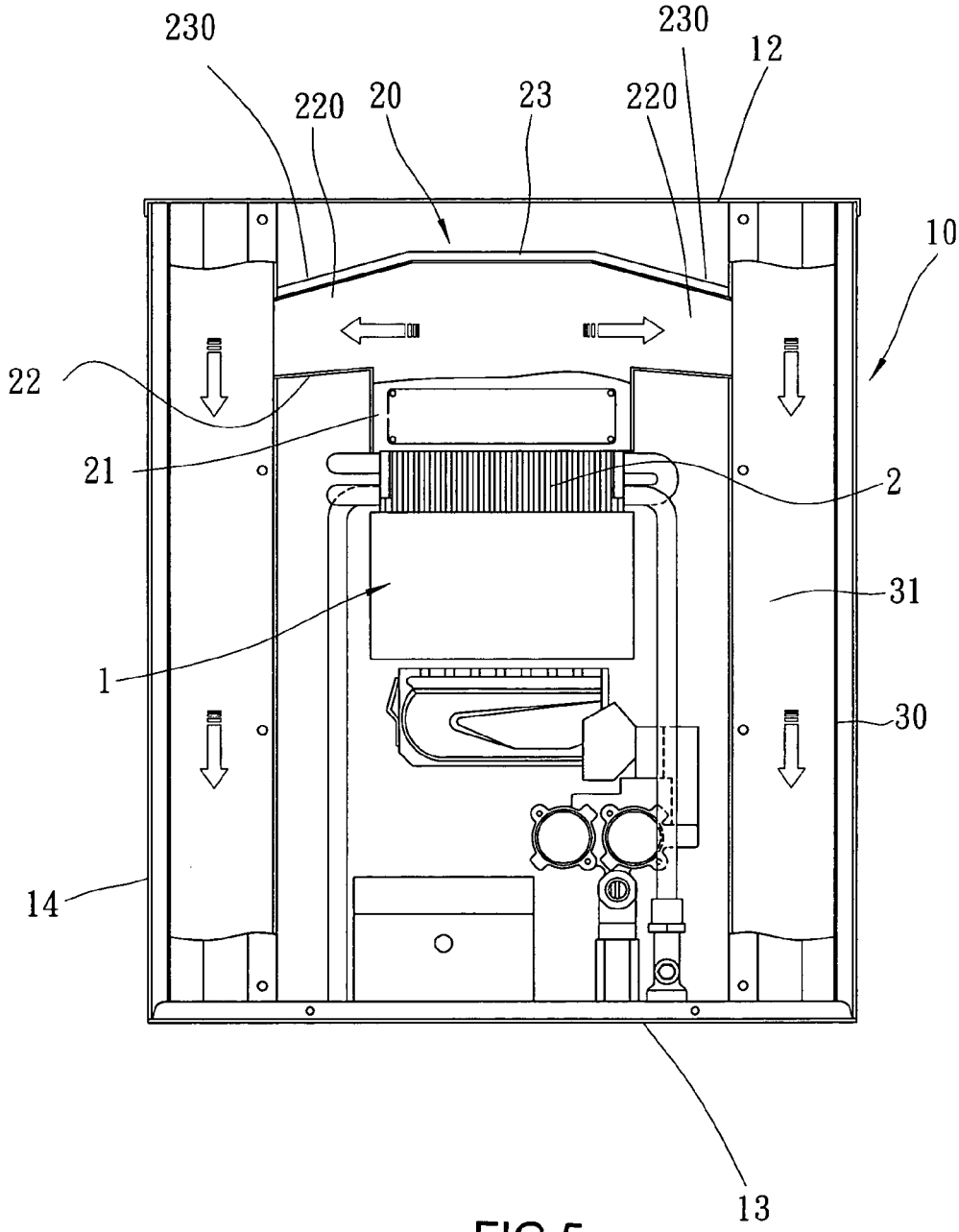
FIG. 5 is a plan cross-sectional operational view of the water heater as shown in FIG. 1

As shown in FIG. 5, when the water heater is mounted outdoors and the air current of the ambient environment is disposed at an abnormal and unstable state, the air current produces a downward pressure on each of the two windproof hoods 30 so that the waste gas produced by the burner 1 cannot be delivered upward in the guide channel 31. At this time, the downward air current passing through the guide channel 31 of each of the two windproof hoods 30 produces a suction force applied on the outlet holes 220 of the drain pipe 22 due to a siphon effect to suck the waste gas produced by the burner 1 through the outlet holes 220 of the drain pipe 22 into the guide channel 31 of each of the two windproof hoods 30, so that the waste gas is carried by the downward air current, then delivered downward in the guide channel 31 and is finally drained outward from the respective vent hole 18 of the bottom cover 13. Thus, the waste gas produced by the burner 1 is drained outward smoothly and regularly, so that the water heater has an enhanced air circulation, thereby facilitating operation of the water heater.

Accordingly, the waste gas produced by the burner 1 is drained outward smoothly and regularly even when the air current of the ambient environment is disposed at an abnormal and unstable state, so that the water heater has an enhanced air circulation to provide a complete combustion to the burner 1, thereby facilitating operation of the water heater. In addition, the air circulation of the water heater is maintained at a stable state, so that the temperature of the hot water is kept at a constant value, thereby facilitating the user operating the water heater. Further, the drain pipe 22 is protected by each of the two windproof hoods 30 to achieve a windproof and rainproof effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A heater, comprising:

a housing;

an air box mounted in the housing and having a transversely arranged drain pipe having two distal ends each formed with an outlet hole connected to an outside of the housing;

two windproof hoods each mounted on the housing and each having an inside formed with a guide channel connected to the respective outlet hole of the drain pipe; wherein the air box has a lower portion formed with a longitudinally arranged inlet manifold located above a heat exchanger to deliver a waste gas produced by a burner located under the heat exchanger and an upper portion formed with the drain pipe connected to the inlet manifold.

2. The heater in accordance with claim 1, wherein an inclined angle is defined between the guide channel of each of the two windproof hoods and the respective outlet hole of the drain pipe so that the drain pipe is protected by each of the two windproof hoods.

3. The heater in accordance with claim 1, wherein the air box is substantially T-shaped.

4. The heater in accordance with claim 1, wherein the drain pipe of the air box has a top plate having a flat mediate portion and two oblique end portions each extended downward toward the respective outlet hole of the drain pipe to introduce the waste gas from the inlet manifold into the respective outlet hole of the drain pipe.

5. The heater in accordance with claim 1, wherein each of the two windproof hoods has two ends each provide with a net.

6. The heater in accordance with claim 1, wherein the guide channel of each of the two windproof hoods is perpendicular to the respective outlet hole of the drain pipe.

7. A heater, comprising:

a housing;

an air box mounted in the housing and having a transversely arranged drain pipe having two distal ends each formed with an outlet hole connected to an outside of the housing;

two windproof hoods each mounted on the housing and each having an inside formed with a guide channel connected to the respective outlet hole of the drain pipe, wherein the housing includes a back plate, a top cover mounted on an upper portion of the back plate, and a bottom cover mounted on a lower portion of the back plate;

the housing further includes two upright base plates mounted on the back plate, thereby defining a mounting space between the two base plates for mounting a burner and a heat exchanger above the burner.

8. The heater in accordance with claim 7, wherein each of the top cover and the bottom cover has two ends each formed with a vent hole, and the guide channel of each of the two windproof hoods is connected to the respective vent hole of each of the top cover and the bottom cover so that the drain pipe is connected to the outside of the housing through the guide channel of each of the two windproof hoods.

9. The heater in accordance with claim 7, wherein the housing further includes a faceplate mounted between the back plate, the top cover and the bottom cover, and the two upright base plates are mounted between the back plate and the faceplate.

10. The heater in accordance with claim 7, wherein each of the two base plates has two sides each formed with a plurality of air inlet holes connected to the mounting space, and the back plate has two sides each formed with a plurality of air inlet bores connected to the air inlet holes of each of the two base plates so that the mounting space is connected to the outside of the housing through the air inlet holes of each of the two base plates and the air inlet bores of the back plate.

11. The heater in accordance with claim 7, wherein each of the two distal ends of the drain pipe is extended through the respective base plate.

12. The heater in accordance with claim 7, wherein each of the two windproof hoods is mounted on the respective base plate and connected to the drain pipe of the air box.

13. The heater in accordance with claim 7, wherein the air box is mounted in the mounting space of the housing.

* * * * *